US005167485A

United States Patent [19]

Starkweather

[11] Patent Number: 5,167,485

[45] Date of Patent: Dec. 1, 1992

[54] SELF-COOLING JOINT CONNECTION FOR ABUTTING SEGMENTS IN A GAS TURBINE ENGINE

[75] Inventor: John H. Starkweather, Cincinnati, Ohio

[73] Assignee: General Electric Company, Cincinnati, Ohio

[21] Appl. No.: 866,094

[22] Filed: Apr. 6, 1992

Related U.S. Application Data

[63] Continuation of Ser. No. 700,359, May 7, 1991, which is a continuation of Ser. No. 461,952, Jan. 8, 1990.

[51] Int. Cl.[5] ..... F01D 9/04

[52] U.S. Cl. ..... 415/115; 415/138; 415/139

[58] Field of Search ..... 415/110, 111, 112, 113, 415/115, 116, 134, 135, 136, 137, 138, 139

[56] References Cited

U.S. PATENT DOCUMENTS

| | | | |
|---|---|---|---|
| 3,947,145 | 3/1976 | Michel et al. | 415/138 |
| 3,965,066 | 6/1976 | Sterman et al. . | |
| 3,986,789 | 10/1976 | Pask . | |
| 4,017,213 | 4/1977 | Przirembel . | |
| 4,465,284 | 8/1984 | Szema . | |
| 4,524,980 | 6/1985 | Lillibridge et al. | 415/115 |
| 4,551,064 | 11/1985 | Pask . | |
| 4,650,394 | 3/1987 | Weidner . | |
| 4,688,988 | 8/1987 | Olsen | 415/116 |
| 4,720,236 | 1/1988 | Stevens . | |
| 4,767,260 | 8/1988 | Clevenger et al. | 415/139 |

FOREIGN PATENT DOCUMENTS

| | | | |
|---|---|---|---|
| 3523145 | 1/1986 | Fed. Rep. of Germany . | |
| 1175816 | 12/1969 | United Kingdom | 415/116 |
| 2166805 | 5/1986 | United Kingdom . | |
| 2195403 | 4/1988 | United Kingdom | 415/113 |
| 2161220 | 9/1988 | United Kingdom . | |

*Primary Examiner*—Edward K. Look
*Assistant Examiner*—Christopher M. Verdier
*Attorney, Agent, or Firm*—Jerome C. Squillaro; David L. Narciso

[57] ABSTRACT

A joint connection for abutting, circumferentially extending segments in a gas turbine engine, such as turbine nozzle segments, includes a sealing member which is insertable between longitudinally extending slots formed in the abutting side edges of two adjacent segments. The segments are each formed with a number of grooves which are longitudinally spaced along the length of the slots therein, and which extend beneath the sealing member carried within the slots. A cooling air flow path is thus formed extending from one side of the sealing member, into the longitudinal slot of each segment and then through the grooves to the opposite side of the sealing member so that the entire joint connection or seal region between the abutting side edges of the segments is cooled.

11 Claims, 1 Drawing Sheet

SELF-COOLING JOINT CONNECTION FOR ABUTTING SEGMENTS IN A GAS TURBINE ENGINE

The Government has rights in this invention pursuant to a contract awarded by the Department of Air Force.

This application is a continuation of application Ser. No. 07/700,359, filed May 7, 1991, which is a continuation of application Ser. No. 07/461,952, filed Jan. 8, 1990.

FIELD OF THE INVENTION

This invention relates to gas turbine engines, and, more particularly, to a self-cooling joint connection for the abutting edges of circumferentially extending segments in gas turbine engines such as turbine bands, shrouds, blade platforms and/or combustor shingles.

BACKGROUND OF THE INVENTION

One of the most important considerations in the design of gas turbine engines is to ensure that various components of the engine are maintained at safe operating temperatures. This is particularly true for elements of the combustor and turbine, which are exposed to the highest operating temperatures in the engine.

In the turbine of gas turbine engines, for example, high thermal efficiency is dependent upon high turbine entry temperatures. These entry temperatures, in turn, are limited by the heat which the materials forming the turbine blades and nozzle guide vanes can safely withstand. In addition to improvements in the types of materials used to fabricate these components, continuous air cooling has been employed to permit the environmental operating temperature of the turbine to exceed the melting point of the materials forming the blade and nozzle guide vanes without affecting their integrity.

A number of techniques are used in an attempt to effectively and uniformly cool the components of the turbine, combustor and other portions of gas turbine engines. The turbine nozzle segments, for example, are conventionally cooled by a combination of air impingement, film, pin fins, convection/film holes and thermal barrier coatings. Each nozzle segment, which comprises inner and outer bands interconnected by fixed nozzle guide vanes, is subjected to a combination of such cooling methods to reduce both the internal and external temperature of the bands and nozzle guide vanes.

One problem area in the cooling of turbine nozzle segments, and other components of the gas turbine engine, is at the joint connections between abutting nozzle segments. In order to prevent thermal hoop stresses, the inner and outer bands supporting the nozzle guide vanes must be segmented, i.e., a number of turbine nozzle segments each having arcuate-shaped inner and outer bands extend circumferentially about the turbine case and abut one another at their side edges. Conventionally, a slot or pocket is formed in the abutting side edge of adjacent turbine nozzle segments and a sealing member extends between the slots of abutting segments to create a seal therebetween. It has been found that this sealing area between abutting segments is cooled less effectively than the remainder of the inner and outer bands of the nozzle segment, which creates an uneven heat distribution along the nozzle segments.

Attempts have been made to improve cooling of the joint connection or seal area between abutting turbine nozzle segments, but problems have been encountered with each design. One design depends on the conduction of heat from the seal area to areas of the inner and outer bands which are impinged with air. Film cooling, i.e., the passage of cooling air closely adjacent the surface of the inner and outer bands, has also been utilized to cool the seal area. Still other designs depend upon leakage of air past the seals to achieve the necessary cooling in the seal area. Conduction of heat to areas of the inner and outer bands which are impinged with cooling air, and film cooling of the seal area, have both proven ineffective to adequately cool the seal region. While the leakage of cooling air past the seals can be sufficient to provide the required cooling, such air leakage is unevenly distributed along the abutting side edges of the nozzle segments and the inner and outer bands thereof can become very hot at localized areas therealong, particularly where the seal is firmly seated and prevents the movement of cooling air therepast.

Another technique which has been suggested to cool the seal area between abutting nozzle segments includes the formation of convection holes between the seal region and the side of the inner and/or outer bands which are impinged by cooling air. Depending upon the temperature of the gases at which the gas turbine engine operates, a relatively large number of convection holes are required. The drilling of such a large number of holes is expensive, and location tolerances are difficult to hold. Additionally, large numbers of convection holes could weaken the part by producing localized stress concentrations thereat. Moreover, such convection holes can produce discontinuities in the thermal barrier coating applied to the hot or gas side of the inner and outer bands of the nozzle segments which reduces the effectiveness of the thermal barrier coating.

SUMMARY OF THE INVENTION

It is therefore among the objectives of this invention to provide a joint connection between the abutting edges of segments in a gas turbine engine, such as the turbine nozzle segments of the turbine, which effectively cools the seal region between abutting segments, which reduces stress concentrations in the seal region, which maintains the integrity of thermal barrier coatings applied to the segments and which controls the flow of cooling air in the seal region.

These objectives are accomplished in a joint connection for abutting segments in a gas turbine engine, such as turbine nozzle segments of the turbine, in which the side edge of both the inner and outer bands of each turbine nozzle segment are formed with a longitudinally extending pocket or slot which extends from the face of such side edges toward the interior of the inner and outer bands. The slots in the side edges of the inner and outer bands are generally U-shaped defining inner and outer walls connected by an interior side wall. In the presently preferred embodiments, one of the inner and outer walls of each U-shaped slot is formed with a number of channels or grooves which extend from the interior side wall to the face of the side edge of the inner and outer bands.

A sealing member extends between the U-shaped slots in the abutting side edges of two adjacent turbine nozzle segments such that the sealing member overlies the grooves formed in the inner or outer wall of the U-shaped slot in each nozzle segment. An air flow path is thus formed in the seal region of abutting nozzle segments wherein cooling air is permitted to flow onto one side of the sealing member, into each of the U-shaped slots in the abutting inner and outer bands of the nozzle segments, around the edges of the sealing member and then into the channels or grooves in inner or outer wall of the U-shaped slot to the opposite side of the sealing member.

This invention is therefore predicated upon the concept of inducing a controlled "leakage" of cooling air around the sealing members which are positioned between the abutting side edges of adjacent nozzle segments in the turbine of a gas turbine engine. The cooling air is directed from one side of the sealing member to the other in a controlled manner, i.e., flow of the cooling air is directed into a number of longitudinally spaced grooves in the U-shaped pockets or slots at the abutting side edges of the nozzle segments so that cooling air is evenly distributed present along the longitudinal extent of the side edges of the nozzle segments. This effectively and uniformly cools the entire seal region to approximately the same temperature as the remaining portions of the inner and outer bands of the nozzle segments and the nozzle guide vanes connected therebetween.

An advantage of the construction of this invention is that convection holes for cooling the seal area can be reduced or eliminated by the grooves in the inner or outer wall of U-shaped slots in the inner and outer bands. Such convection holes, which extend between the side of the inner and outer bands impinged with cooling air to the seal region, can be difficult to properly locate and may create stress concentrations in the part, particularly if a large number of convection holes are required. The elimination or substantial reduction of such convection holes also reduces discontinuities in the thermal barrier coating applied to the hot or gas side of the inner and outer bands of the nozzle segments.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
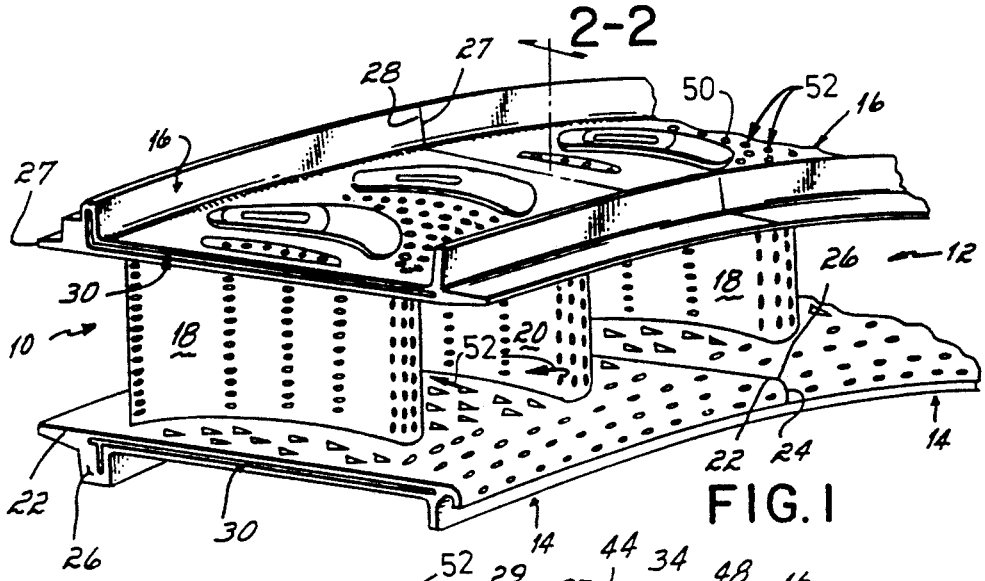
FIG. 1 is a schematic, perspective view of two abutting turbine nozzle segments of a gas turbine engine employing the side edge seal of this invention.

Referring now to the Figures a first turbine nozzle segment 10 and part of a second nozzle segment 12 are shown abutting one another forming a portion of an essentially continuous, circumferentially extending stage of nozzle segments within the turbine of a gas turbine engine. For purposes of the present discussion, only the construction of turbine nozzle segment 10 is discussed in detail, it being understood that the other nozzle segment 12, and all other nozzle segments within the turbine, are structurally and functionally identical.

The turbine nozzle segment 10 comprises an inner band 14, an outer band 16 and a pair of nozzle guide vanes 18, 20 connected between the inner and outer bands 14, 16. The inner band 14, outer band 16, and nozzle guide vanes 18 and 20 are shown as including film cooling holes 50 which serve as passages to provide cooling air 52 through the parts for convection cooling and to surfaces exposed to hot gases for film cooling. The inner band 14 of nozzle segment 10 is formed with opposed side edges 22, 24, each having a face 26. Similarly, the outer band 16 of nozzle segment 10 is formed with opposed side edges 27, 28 each having a face 29. In the assembled position, the side edges 22, 24 of inner band 14 and side edges 27, 28 of outer band 16 abut the same structure of adjacent nozzle segments, such as nozzle segment 12, to form an essentially continuous, circumferentially extending stage of nozzle segments in the turbine of a gas turbine engine.

The side edges 22, 24 of the inner band 14 and the side edges 27, 28 of the outer band 16 are each formed with a longitudinally extending pocket or slot 30. For purposes of the present discussion, the slot 30 in abutting side edges 27, 28 of the outer bands 16 of segments 10, 12 is described in detail, it being understood that the slots 30 in the inner band 14 thereof are identical in structure and function.

Figure 2:
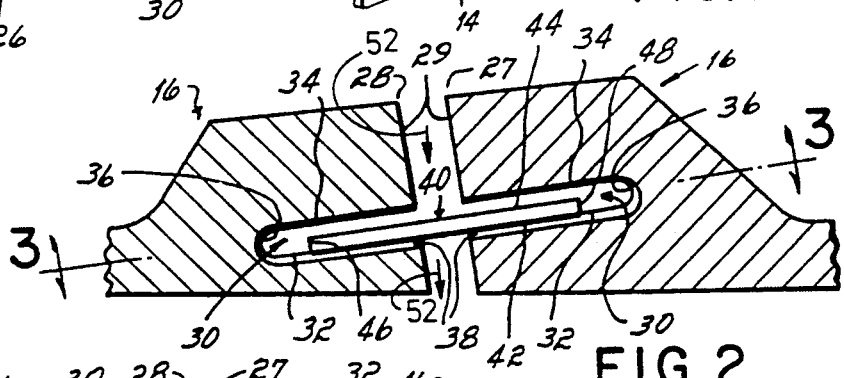
FIG. 2 is a cross sectional view of the abutting nozzle segments taken generally along line 2—2 of FIG. 1.
Figure 3:
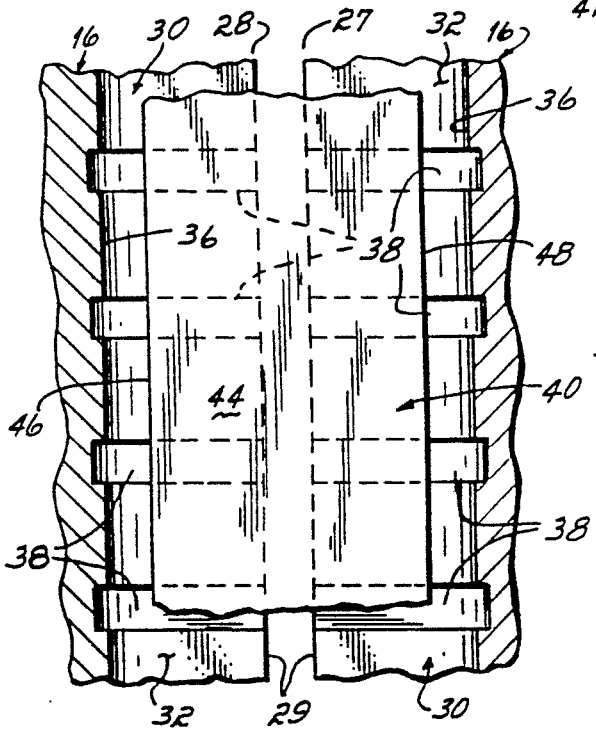
FIG. 3 is a view taken generally along line 3—3 of FIG. 2 illustrating the sealing member in position atop the grooves in the U-shaped slots in the side edges of each turbine nozzle segment.
Figure 4:
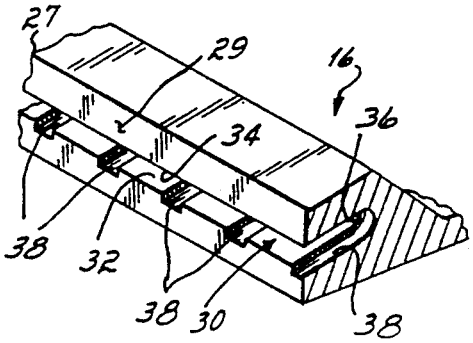
FIG. 4 is a partial perspective view of a portion of the side edge of one band of a turbine nozzle segment.

Referring to FIGS. 2 and 3, the joint connection of the outer bands 16 of nozzle segments 10 and 12 is illustrated wherein the side edge 28 of the outer band 16 of segment 10 abuts the side edge 27 of the outer band 16 of segment 12. The gap or space between the abutting outer bands 16 is exaggerated in FIGS. 2 and 3 for purposes of illustration. The slot 30 in side edges 27, 28 of each outer band 16 is substantially U-shaped and extends from the face 29 of the side edges 27, 28 toward the interior of each outer band 16. Each U-shaped slot 30 forms an inner wall 32, an outer wall 34 and an arcuate-shaped interior side wall 36 extending therebetween. In the presently preferred embodiment, a number of longitudinally spaced channels or grooves 38 are formed in the inner wall 32 along the length of slot 30 which extend along a portion of the interior side wall 36 to the face 29 of the side edge 27 or 28 of the outer bands 16.

A sealing member 40, formed with an inner surface 42, outer surface 44 and opposed edges 46, 48, spans the gap between adjacent nozzle segments 10, 12 and extends within the longitudinal slots 30 formed in the abutting side edges 27 and 28 of their outer bands 16. In this position, the inner surface 42 of sealing member 40 rests atop the inner wall 32 of the slots 30 and overlies the grooves 38 formed along the inner wall 32 thereof. Preferably, the sealing member 40 extends from the face 29 of each side edge 27, 28 of abutting outer bands 16 toward, but not in contact with, the interior side wall 36.

The purpose of the joint connection of this invention between the abutting nozzle segments 10, 12 is to permit the flow of cooling air 52 into the "seal area or region" therebetween, i.e., the area of the abutting side edges 22, 24 of the inner bands 14 and the side edges 27, 28 of outer bands 16. A cooling air flow path is created by the sealing member 40 and the configuration of slots 30 which effectively cools the seal area. Specifically, cooling air 52 is directed onto the outer surface 44 of the sealing member 40 and flows therealong into the slots 30 of each nozzle segment 10 and 12. This cooling air 52 then flows over the edges 46, 48 of the sealing member 40, along the interior side wall 36 of the slots 30 and into the channels or grooves 38 in the inner wall 32 of slot 30 to the opposite, inner side 42 of the sealing member 40. The grooves 38 are longitudinally spaced along the inner wall 32 of slot 30 to ensure that the entire longitudinal extent of the side edges 22, 24 of inner bands 14 and side edges 27, 28 of outer bands 16 receives cooling air 52. This effectively cools the sealing area between the nozzle segments 10, 12 and ensures that cooling of the inner and outer bands 14, 16 of nozzle segments 10, 12 is uniformly distributed throughout the entire area thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the joint connection disclosed in this invention was illustrated as creating a self-cooling seal or joint connection between abutting turbine nozzle segments in the turbine of a gas turbine engine. It should be understood, however, that the self-cooling joint connection herein could also be utilized in other areas of the gas turbine engine such as stator vane platforms and shrouds in the compressor, combustor shingles in the combustor, and any other segmented elements of the gas turbine engine in which cooling of the abutting surfaces of adjacent segments is desirable.

Therefore, it is intended that the invention not be limited to the particular embodiment disclosed as the best mode contemplated for carrying out this invention, but the invention will include all embodiments falling within the scope of the appended claims.

Wherefore, I claim:

1. In a gas turbine engine including at least one section comprising a plurality of circumferentially adjacent segments, each of said segments having inner and outer surfaces in communication with gas flows and passages for providing cooling air from one surface to the other, and a pair of opposed side edges, each side edge having a face extending between said inner and outer surfaces, abutting the side edges of adjacent segments, a joint connection between said abutting side edges of said circumferentially adjacent segments comprising:

a first slot having an axis extending in a first direction and formed in one side edge of a first segment, said first slot extending from the face of said one side edge of the first segment toward the opposite side edge thereof, said first slot defining an imperforate inner wall, an imperforate outer wall and an imperforate interior side wall extending between said inner and outer walls, one of said inner and outer walls being formed with grooves having axes extending transverse to said first direction, each extending in said one of said inner and outer walls between said interior side wall of said first slot and the face of said one side edge of the first segment;

a second slot having an axis extending in a first direction and formed in one side edge of a second segment, said second slot extending from the face of said one side edge of the second segment toward the opposite side edge thereof, said second slot defining an imperforate inner wall, an imperforate outer wall and an imperforate interior side wall extending between said inner and outer walls, one of said inner and outer walls being formed with grooves having axes extending transverse to said first direction, each extending in said one of said inner and outer walls between said interior side wall of said second slot and the face of said one side edge of the second segment; and a symmetrical sealing member extending between said first slot in the first segment and said second slot in the second segment, said sealing member having a first side overlying said grooves in each of the first and second segments and a second side opposite said grooves, whereby an air flow path is formed between the abutting side edges of the first and second segments in which a flow of cooling air is first directed onto said second side of said sealing member, into said first slot in the first segment and the second slot in the second segment and then through said grooves of said first and second slots to said first side of said sealing member.

2. The joint connection of claim 1 in a turbine nozzle of a turbine in a gas turbine engine, said turbine nozzle comprising circumferentially adjacent segments, each turbine nozzle segment including an inner band, an outer band, and at least one nozzle guide vane connected therebetween, wherein said inner band and said outer band are each comprised of said first and said second segments.

3. The joint connection of claim 1 in which said grooves are formed in said inner wall of said first and second slots.

4. The joint connection of claim 1 in which said interior side wall of said first and second slots is arcuate in shape between said inner and outer walls thereof.

5. The joint connection of claim 1 in which said grooves extend at least partially along said interior side wall of said first and second slots in a radial direction.

6. The joint connection of claim 1 in which said grooves extend along the entire width of said inner wall of said first and second slots between said interior side wall and the face of said one side edge of both the first and second segments.

7. A turbine nozzle segment for a gas turbine engine, comprising an inner band formed with opposed side edges, an inner surface, an outer surface, and holes for providing cooling air from said inner band inner surface to said inner band outer surface;

an outer band formed with opposed side edges, an inner surface, an outer surface, and holes for providing cooling air from said outer band outer surface to said outer band inner surface;

at least one nozzle guide vane connected between said outer surface of said inner band and said inner surface of said outer band;

each of said side edges of said inner and outer bands being formed with a longitudinally extending slot defining an imperforate inner wall, an imperforate outer wall and an imperforate interior side wall extending therebetween, one of said inner and outer walls of said slot being formed with longitudinally spaced grooves to permit the passage of cooling air therealong.

8. The turbine nozzle segment of claim 7 in which said side edge of each said inner and outer bands is formed with a face, said grooves extending in a circumferential direction at least partially between said interior side wall of said slots and said face of said side edges of said inner and outer bands.

9. The turbine nozzle segment of claim 8 in which said grooves are formed in a portion of said interior side wall of said slots in each said inner and outer bands in a radial direction, said grooves extending from said radial direction to a circumferential direction between said interior side wall of said slots and said face of said side edges of each said inner and outer bands.

10. The turbine nozzle segment of claim 7 in which said interior side wall of each said slot is arcuate in shape between said inner and outer walls thereof.

11. The method of cooling abutting side edges of circumferentially extending segments in a gas turbine engine, the segments including holes for providing cooling air through the segments, the method of cooling abutting side edges comprising:

directing cooling air onto a first side of a symmetrical sealing member carried within a longitudinally extending slot formed in the side edge of a first segment and within a longitudinally extending slot formed in the side edge of an abutting, second segment;

directing the cooling air from said first side of said sealing member into the imperforate interior of each said longitudinally extending slots;

directing the cooling air into grooves formed in each of the first and second segments within said interior of said longitudinally extending slots therein, the opposite, second side of the sealing member overlying said grooves within said slots so that the cooling air flows from said first side of said sealing member into said grooves and then to said opposite, second side of the sealing member.

* * * * *